US006095676A

United States Patent [19]

Kuan

[11] Patent Number: 6,095,676

[45] Date of Patent: Aug. 1, 2000

[54] DAIRY PRODUCT WHIPPING APPARATUS

[76] Inventor: Huo Feng Hsia Kuan, No. 32, Lane 2, Show-Gang Wu Street, Hsin-Tien, Taipei Hsien, Taiwan

[21] Appl. No.: 09/222,891

[22] Filed: Dec. 30, 1998

[51] Int. Cl.[7] ..... B01F 11/00; B01F 7/16

[52] U.S. Cl. ..... 366/256; 366/332

[58] Field of Search ..... 366/255, 256, 366/257, 289, 130, 332, 333, 334, 244

[56] References Cited

U.S. PATENT DOCUMENTS

| | | | |
|---|---|---|---|
| 1,597,271 | 8/1926 | Fleek | 366/333 |
| 1,966,352 | 7/1934 | Mahony | 366/130 |
| 4,946,286 | 8/1990 | Purkapile | 366/289 |
| 5,284,389 | 2/1994 | Lumsden | 366/256 |
| 5,580,169 | 12/1996 | Ghidini | 366/256 |
| 5,780,087 | 7/1998 | Brady | 366/256 |

FOREIGN PATENT DOCUMENTS

| | | | |
|---|---|---|---|
| 237660 | 8/1925 | United Kingdom | 366/256 |

*Primary Examiner*—Tony G. Soohoo

*Attorney, Agent, or Firm*—Dougherty & Troxell

[57] ABSTRACT

A dairy product whipping apparatus includes a container, an upper cover, a spindle, a rotary device, and a press disk device. The user may hold a grip knob on the upper cover to work it longitudinally so that the press disk device disposed inside the container displace longitudinally synchronously to cause a powder form dairy product and water inside the container to mix. During the reciprocating displacement of the press disk, a whip is produced and passes through through a screen. A rotary disk displaces longitudinally in a reciprocating and revolving manner along the threads of a screw rod so that the whip passes through holes in the rotary disk. Blades on the rotary disk rotate clockwisely and counter-clockwisely to generate a water current which speeds up the mixing of the dairy product and the water in a consistent manner to form a finer whip.

7 Claims, 3 Drawing Sheets

DAIRY PRODUCT WHIPPING APPARATUS

BACKGROUND OF THE INVENTION (a) Field of the Invention:

The present invention relates to a dairy product whipping apparatus, more particularly a whipping apparatus that can form a whipped cream from milk powder, creamer, or fresh milk in a quick manner. Besides, the milk or creamer can mix with the water consistently to prevent formation of lumps.

(b) Description of the Prior Art:

Coffee has become a necessity of life. There are different kinds of coffee drinks, including cappuccino, latte, espresso, etc. For cappuccino and latte, a cream is added to the surface of the coffee.

At present, the more common apparatus for making cream is to employ high pressure steaming or use a manually operated cream maker. In the former, high pressure steam is used to make coffee. One side of the coffee maker is provided with a steel tube. When a control knob is turned, the steel tube will eject steam so that fresh milk in a cup will form a cream at the continuous bursts of steam, for addition to a cappuccino or latte. In the manual operated type, a hollow container has a top portion with an opening end fitted to an upper cover, and the upper cover is centrally provided with a through cover hole for passage of a spindle. The bottom portion of the spindle is connected to a base disk and a screen. The rim of the screen contacts the inner wall of the container. In use, milk powder or creamer (hereinafter referred to as "dairy product") is put into the container and water is added thereto so as to mix with the dairy product. The upper cover is then put in place on the container. By pulling and pushing a grip knob at a top end of the spindle repeatedly, the base disk and the screen are caused to displace upwardly and downward, whereby the mixture of dairy product and water is whipped into a cream. A main drawback with the manually operated whipping apparatus is that, during the whipping process, there is only the upward and downward displacement of the base disk and the screen, without means to prevent formation of lumps of dairy product that has not dissolved in the water, so that powders or lumps of dairy product are deposited on the bottom of the container, which is a waste of the dairy product and makes the container difficult to wash.

SUMMARY OF THE INVENTION

A primary object of the present invention is to provide a dairy product whipping apparatus, whereby a dairy product can mix well with water to create a fine whip of excellent consistency without deposits of lumps on the bottom of a container.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
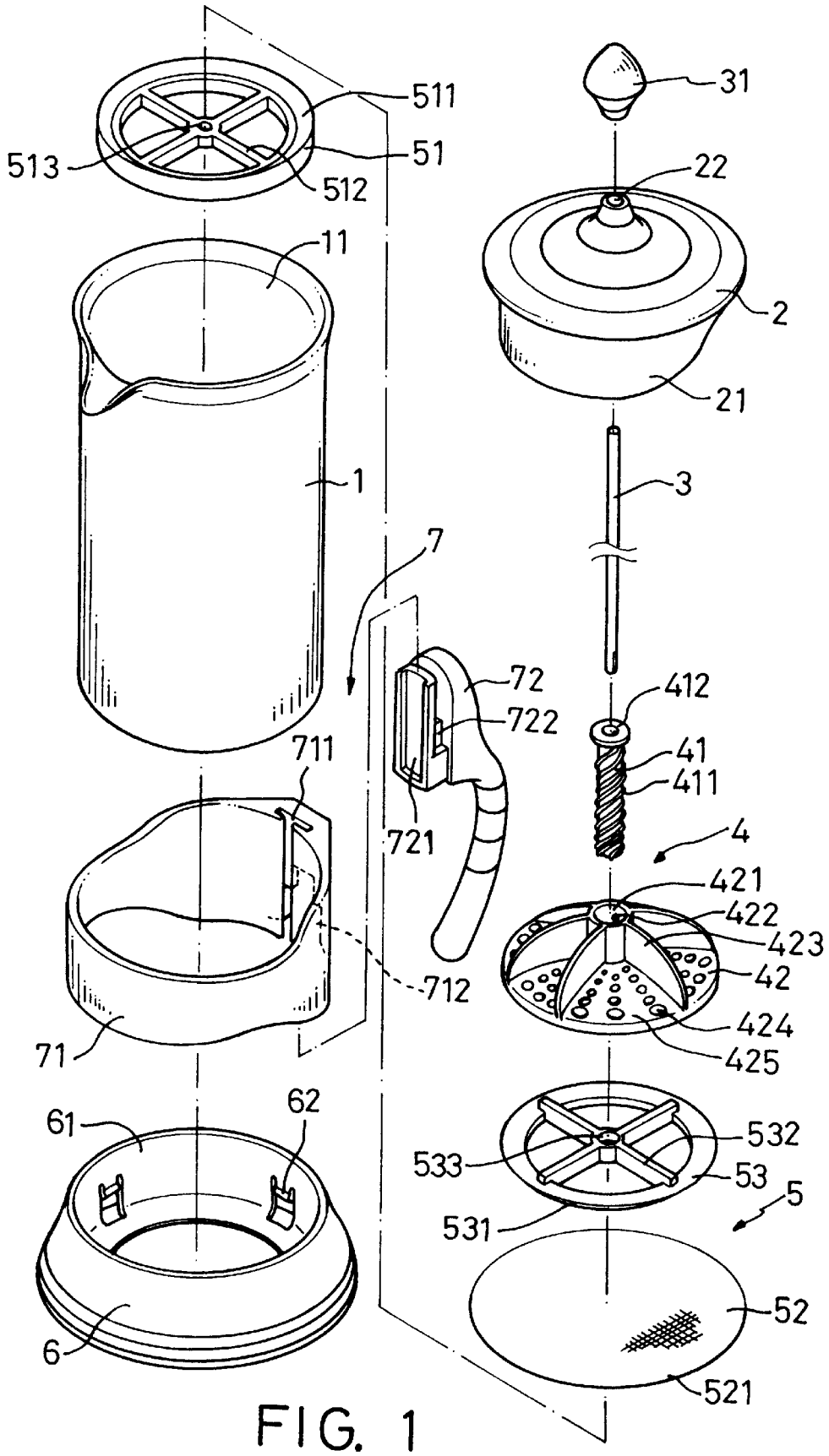
FIG. 1 is a perspective exploded view of the dairy product whipping apparatus according to the present invention.
Figure 2:
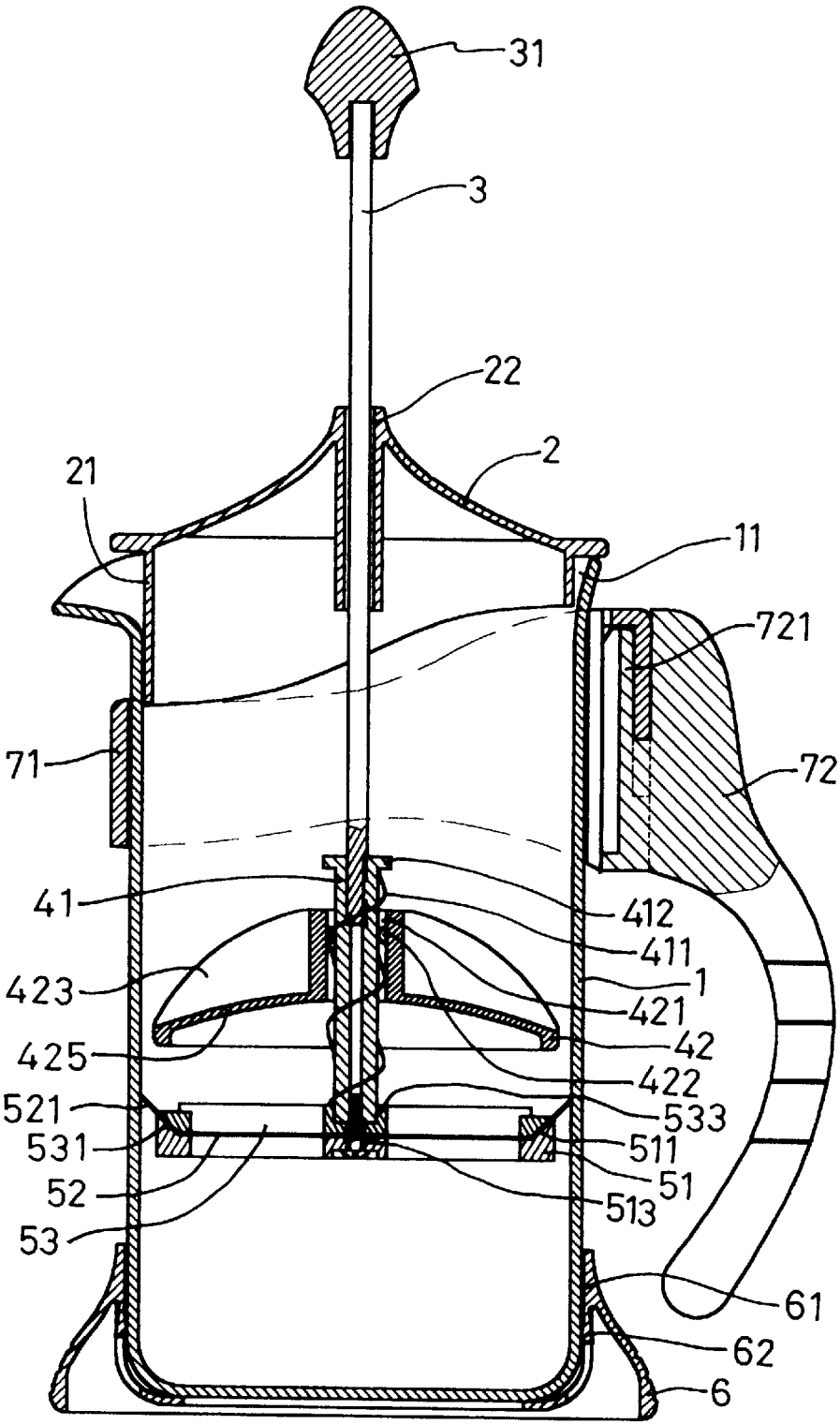
FIG. 2 is a sectional view of the present invention after assembly.
Figure 3:
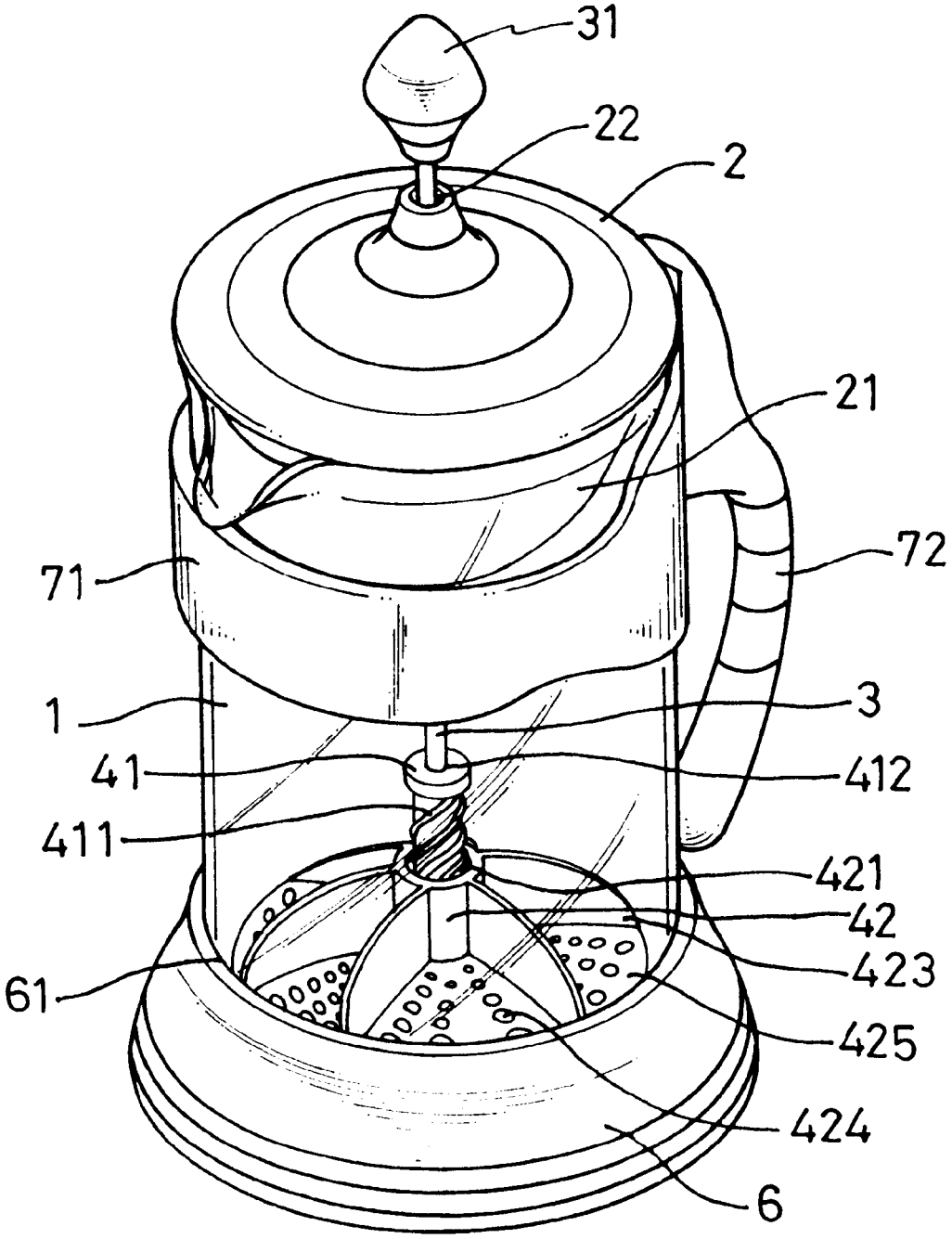
FIG. 3 is a perspective view of the present invention after assembly.

With reference to FIGS. 1–3, a dairy product whipping apparatus according to the present invention comprises a container 1, an upper cover 2, a spindle 3, a rotary device 4, and a press disk device 5.

The container 1 a hollow structure that has a top portion with an opening end 11 for filling of a dairy product in powder form. The opening end 11 is fitted with the upper cover 2.

The upper cover 2 has a bottom portion that has a cover rim 21 extending downwardly therefrom and corresponding to the opening end 11 of the container 1 for coupling with the opening end 11 so as to close the container 1. The upper cover is centrally provided with a cover hole 22 for passage of the spindle 3 therethrough.

The spindle 3 is an elongated rod that passes through the cover hole 22. The spindle 3 is connected to a grip knob 31 and has a bottom portion insertably coupled to the rotary device 4.

The rotary device 4 includes a screw rod 41 for insertable connection with the spindle 3, and a rotary disk 42. The screw rod 41 includes a threaded portion 411 including a plurality of external threads, and has a top portion provided with a stop piece 412. The rotary disk 42 is centrally provided with a disk hole 421 that has a plurality of disk bosses 422 on the wall of the disk hole 421. The threaded portion 411 extends into the disk hole 421 to engage with the disk bosses 422 so that the rotary disk 42 can displace upwardly and downwardly following the threaded portion 411 to prevent slippage of the rotary disk 42 from the top portion of the screw rod 41. The stop piece 412 of the screw rod 41 is sized to be larger than the disk hole 421 so as to a serve an upper limit for the displacement of the rotary disk 42. The rotary disk 42 further includes a disk body 425, a plurality of through holes 424 in the disk body 425, and a plurality of blades 23 oppositely provided on upper and lower sides of the disk body 425. When the rotary disk 42 rotates in a reciprocating manner, the blades 423 drives the currents of liquid and cooperate with the through holes 424 in the disk body 425 to cause the whip to pass through the through holes 424 so that a dairy product whip is formed on the disk body 425.

The press disk device 5 includes a base disk 51, a screen 52, and a sealing disk 53. The base disk 51 has a size slightly smaller than the internal diameter of the container 1, and a top portion with a periphery having a top slanting rim 511 that slants downwardly. One or more disk supports 512 extending inwardly from the top slanting rim 511. The meeting point of the supports (i.e., the theoretical center of the base disk 51) is provided with a locking hole 512. The screen 52 is placed above the base disk 51. The sealing disk 53 has a bottom slanting rim 531 corresponding to the top slanting rim 511 of the base disk 51, and is placed above the screen 52. The sealing disk 53 is further provided with supports 532 and a rod hole 533 to correspond with the supports 512 and the locking hole 513 of the base disk 51. The screw rod 41 passes through the rod hole 533, and a screw is used to pass through the locking hole 513 and the screen 52 to be lockably coupled to the screw rod 41 so as to secure the press disk device 5 to the bottom portion of the screw rod 41. The screen 52 has a periphery end 521 that tilts upwardly due to the configuration of the top and bottom slanting rims 511, 531 so as to have a preferred contact relationship with the inner wall of the container 1. Preferably, the angle of the top and bottom slanting rims is 45 degrees.

When it is desired to whip a dairy product in powder form, the dairy product is placed on the bottom portion of the container 1, and boiled water of a suitable temperature is poured in. Then the upper cover 2 is put in place on the opening end 11 of the container 1. At this point, the spindle 3, the rotary device 4 and the press disk device 5 are received in the container 1. The user may then hold the grip knob 31 with one hand and press the upper cover 2 with the other end to proceed with a pumping operation so that the upper and lower sides of the press disk device 5 are in contact with the dairy product to speed up the mixing of the dairy product with water. The mixture then passes through the screen 52, and a whip is formed. At this time, the disk bosses 422 on the wall of the disk hole 421 of the rotary disk 42 displace longitudinally along the threaded portion 411 of the screw rod 41 in a rotary manner so that the initially formed whip passing through the screen 52 are turned by the blades 423 on the rotary disk 42 and caused to pass quickly through the through holes 424 in the disk body 425, and a finer whip is formed. The water currents generated by the blades 424 stir the mixture of water and dairy product which is in the form of powder or lumps, so that it will not deposit on the rim of the bottom portion of the container 1. In the present invention, rotation of the blades 423 of the rotary disk 42 can not only produces a finer whip, the revolving currents that go in a reciprocating manner generated thereby and the longitudinal water currents generated by the press disk device 5 speed up the mixing of water and the dairy product in a consistent form to facilitate the formation of a fine whip without residual of powders or lumps of dairy product.

After operation, the user only needs to take out the whip with a spoon and add it to a cup of coffee to obtain a cappuccino or latte.

Furthermore, the container 1 of the present invention additionally indudes a base 6 that has a recess 61 at the center to match the size of the bottom portion of the container 1. The wall of the recess 62 may be provided with three or more retaining projections 62 adapted to enhance coupling with the container 1. Moreover, a handle 7 may be provided on the outer periphery of the container 1 to facilitate holding of the container 1. The handle 7 includes a fitting ring 71 and a curved grip portion 72. The fitting ring 71 is sized to match the outer periphery of the container 1 so as to be fittable therewith. One side of the fitting ring 71 is provided with a T-shaped groove 711 on an inner wall and a convex groove 712 on an outer wall. The handle 72, on the other hand, is provided with a plate projection 721 and a handle projection 722 to correspond to the T-shaped groove 711 and the convex groove 712 for respective insertion thereinto for engagement purposes.

In the present invention, the user can hold the grip knob 31 and work it upwardly and downwardly, so that the spindle 3 can displace longitudinally and the press disk device 5 can exert a longitudinal impact force to cause the powder form dairy product to mix with the water and the whip thus formed to pass through the screen 52. In addition, during rotation of the rotary device 4, a finer whip is formed. Besides, the blades 423 that rotate both clockwisely and counter-clockwisely cause the water current to stir the mixture of dairy product and water in a reciprocating manner so that no residue is deposited on the bottom of the container 1. The present invention can also be adapted to be a tea maker; however, a detailed description thereof is omitted herein.

Although the present invention has been illustrated and described with reference to the preferred embodiment thereof, it should be understood that it is in no way limited to the details of such embodiment but is capable of numerous modifications within the scope of the appended claims.

What is claimed is:

1. A dairy product whipping apparatus, comprising:

a container that is hollow and has a top portion provided with an opening end for receiving a dairy product and water;

an upper cover that has a bottom rim provided with a cover rim extending therefrom and corresponding to said opening end of said container so as to close said opening end, said upper cover being centrally provided with a cover hole;

a spindle that is an elongated rod and has a top portion passing through said cover hole to connect to a grip knob;

a rotary device that includes a screw rod and rotary disk, said screw rod having a top portion fitted with a bottom portion of said spindle and a threaded portion circumferentially provided with threads, said top portion of said screw rod having a stop piece, said rotary disk being centrally provided with a disk hole that has a plurality of disk bosses on a wall thereof to engage said threaded portion of said screw rod, said rotary disk having a bottom portion forming a disk body that is provided with a plurality of through holes and a plurality of blades oppositely disposed on upper and lower sides thereof;

a press disk device that includes a base disk, a sealing disk, and a screen disposed between said base disk and said sealing disk, said base disk and said sealing disk each including a hollowed out portion provided with three or more supports, the intersection of said supports of said base disk defining a locking hole while the intersection of said supports of said rotary disk defines a rod hole, a screw passing through said locking hole and said screen, said screw rod having a bottom portion thereof received in said rod hole to be lockably secured therein so that said press disk device can be fixedly provided on said bottom portion of said screw rod, said screen having a peripheral rim in contact with an inner wall of said container;

whereby said grip knob can be held and worked longitudinally to cause said press disk in said container to displace longitudinally, causing the dairy product and water in said container to mix well, said rotary disk displacing longitudinally in a revolving manner along aid threaded portion of said screw rod so that the whip can pass through said through holes in said rotary disk, said blades on said rotary disk rotating both clockwisely and counter-clockwisely to generate revolving water currents to speed up the mixing of the dairy product and water so as to obtain a finer whip.

2. A dairy product whipping apparatus as claimed in claim 1, wherein said base disk and said sealing disk are respectively provided with a slanting rim at they contact so that said peripheral rim of said screen can extend upwardly.

3. A dairy product whipping apparatus as claimed in claim 2, wherein said slanting rims of said base disk and said sealing disk preferably have an angle of 45 degrees.

4. A dairy product whipping apparatus as claimed in claim 1, wherein said container further includes a base provided on a bottom portion thereof to facilitate placement thereof.

5. A dairy product whipping apparatus as claimed in claim 4, wherein said base is centrally provided with a recess for receiving said container, said recess having a surrounding wall that is provided with three or more retaining projections for retaining and positioning said container.

6. A dairy product whipping apparatus as claimed in claim 1, wherein said container further includes a handle to facilitate holding.

7. A dairy product whipping apparatus as claimed in claim 6, wherein said handle includes a fitting ring and a curved grip portion, said fitting ring being fitted onto said container, said fitting ring having respective insert grooves provided externally and internally of one side thereof, said grip portion being provided with projections corresponding to said insert grooves of said fitting ring for insertable engagement with said fitting ring.

* * * * *